US011000096B2

(12) United States Patent
Hamilton

(10) Patent No.: US 11,000,096 B2
(45) Date of Patent: May 11, 2021

(54) SYSTEM AND METHOD OF TYING A SHOELACE

(71) Applicant: Lana Hamilton, Dallas, TX (US)

(72) Inventor: Lana Hamilton, Dallas, TX (US)

( * ) Notice: Subject to any disclaimer, the term of this patent is extended or adjusted under 35 U.S.C. 154(b) by 138 days.

(21) Appl. No.: 16/132,711

(22) Filed: Sep. 17, 2018

(65) Prior Publication Data

US 2020/0085145 A1 Mar. 19, 2020

(51) Int. Cl.
*A43C 7/00* (2006.01)
*A43C 1/04* (2006.01)
*A43C 11/00* (2006.01)

(52) U.S. Cl.
CPC ..... *A43C 7/00* (2013.01); *A43C 1/04* (2013.01); *A43C 11/008* (2013.01)

(58) Field of Classification Search
CPC ..... A43C 7/00; A43C 1/04; A43C 11/008; Y10T 24/3705; Y10T 24/3703
See application file for complete search history.

(56) References Cited

U.S. PATENT DOCUMENTS 656,431 A * 8/1900 Stewart ..... F16G 11/10 24/130
757,820 A * 4/1904 Lykke ..... F16G 11/10 24/130
841,419 A * 1/1907 Molkenbur ..... A43C 7/00 24/712.4
1,225,623 A * 5/1917 Hall et al. ..... F16G 11/00 24/129 R
1,348,475 A * 8/1920 Bullock, Jr. ..... A43C 7/00 24/712.2
1,778,954 A * 10/1930 Mislin ..... A43C 7/00 24/713
3,296,669 A * 1/1967 Elder, Jr. ..... A43C 7/00 24/712.6
4,290,172 A * 9/1981 Burton ..... A43C 7/00 24/129 R
4,760,624 A * 8/1988 Fish ..... B25B 9/00 24/30.55
4,896,366 A * 1/1990 Oxman ..... B65D 33/1625 24/30.5 S
5,119,539 A * 6/1992 Curry ..... A43C 7/00 24/130
5,311,646 A * 5/1994 Eischen, Sr. ..... B65D 33/1625 24/30.5 S
5,465,442 A * 11/1995 Merser ..... A43D 11/10 12/113

(Continued)

OTHER PUBLICATIONS

Summer 2017—EZLeaps web site print out, http://www.ezleaps.com, Copyright © EZLeaps, LLC 2018, printed Sep. 17, 2018, 2 pages.

*Primary Examiner* — Robert Sandy
*Assistant Examiner* — Rowland Do
(74) *Attorney, Agent, or Firm* — Baker Botts L.L.P.

(57) ABSTRACT

A frame for tying a shoelace comprises one or more protrusions and one or more apertures. At least one of the one or more apertures of the frame comprises a diameter operable to receive a first end of the shoelace. The one or more protrusions of the frame are positioned about the at least one of the one or more apertures of the frame and the one or more protrusions of the frame are operable to engage the shoelace and resist movement of the shoelace within the at least one aperture of the frame.

3 Claims, 3 Drawing Sheets

(56) References Cited

U.S. PATENT DOCUMENTS

| | | | | |
|---|---|---|---|---|
| 5,979,028 | A * | 11/1999 | Hicks | A43B 3/0078 24/130 |
| 6,938,308 | B2 * | 9/2005 | Funk | A43C 7/00 24/130 |
| 9,254,019 | B2 * | 2/2016 | Sloan | A43C 19/00 |
| 9,347,522 | B2 * | 5/2016 | DeLuca | F16G 11/103 |
| 9,427,045 | B1 * | 8/2016 | Hannon | A43C 1/06 |
| D806,376 | S * | 1/2018 | Sears | D2/976 |
| 2008/0229562 | A1 * | 9/2008 | Welling | A43C 1/00 24/712 |
| 2011/0113606 | A1 * | 5/2011 | Sloan | 24/713.4 |
| 2012/0284976 | A1 * | 11/2012 | Cox | A43C 7/00 24/712.4 |
| 2014/0020263 | A1 * | 1/2014 | Theuvenet | A43B 3/001 36/50.1 |
| 2014/0115842 | A1 * | 5/2014 | Sloan | A43C 7/00 24/712.2 |
| 2015/0223569 | A1 * | 8/2015 | Cox | A43C 7/00 24/712.4 |
| 2016/0029745 | A1 * | 2/2016 | Atherinos | A43C 7/00 24/712.1 |

* cited by examiner

SYSTEM AND METHOD OF TYING A SHOELACE

TECHNICAL FIELD

This disclosure generally relates to tying a shoelace and, more specifically, to a frame to assist in the tying a shoelace.

BACKGROUND

Tying shoelaces can be prohibitively difficult for some individuals. For example, tying shoelaces may be difficult for those who are young and learning, those who suffer from a disability, those who suffer from arthritis, or those who otherwise lack the necessary finger dexterity. To many individuals, the most difficult part of tying a shoelace is holding a shoelace in one or more loops as they complete a knot. Specifically, an individual may struggle with holding one or more loops together as they complete subsequent steps of tying a knot for a shoe.

There are many types of knots that are operable to tie a shoe. For example, two popular methods for tying a shoelace are known as (1) the "bunny ears" method (the "BE Method"); and (2) the "loop, swoop, and pull" method (the "LSP Method"). Both of these methods involve the formation of a half-hitch knot and at least one shoelace loop. As used herein, a "half-hitch knot" is formed by crossing two ends (or loops) of a shoelace, bringing one end under the crossed pair, and pulling both ends taut. Generally, performance of the LSP Method involves creating a half-hitch knot and then forming a first loop from one end of the shoelace. After the first loop has been formed, the LSP method is completed by circumscribing the first loop with the other end of the shoelace (the second end) thereby creating a ring about the first loop, and threading the second end of the shoelace through the ring. Threading the second end of the shoelace through the ring constricts the ring, thereby forming a bow. In other words, the LSP method is performed by first creating a loop, performing a swoop about the loop, and pulling the shoelace through the swoop.

Comparatively, the BE Method requires the formation of two loops. Generally, this method involves creating a half-hitch knot and then forming a loop from each end of the shoelace, thereby creating two loops that resemble two ears of a bunny. While holding both ends of the shoelace in loops, a half-hitch knot is then formed from the two loops. This method requires not one, but both ends, of the shoelace to be held in a loop while completing the bow.

Because many persons struggle with tying shoelaces, solutions have been devised for individuals unable or unwilling to tie shoelaces. For example, hook-and-loop (i.e., Velcro™) straps or slip-on shoelaces provide alternatives to shoelaces entirely. These solutions are insufficient in that they limit available shoes to hook-and-loop or slip-on shoes. Further, in many situations, an individual may prefer to have laced shoes instead of hook-and-loop or slip-on shoes (e.g., due to personal preference or etiquette). These solutions are further insufficient in that they do not aid an individual in improving their shoe tying ability (e.g., children learning to tie shoes). Further, these solutions, however, do not help an individual in the shoelace tying process.

At least one solution has been created to assist in tying a shoelace. This solution is marketed and sold by EZLeaps, LLC ("EZLeeps"). Generally, EZLeaps sells a product similar in size to a playing card and includes a plurality of holes through which a shoelace is threaded and ultimately tied in a bow. The plurality of holes on the EZLeaps product are connected by cut-outs which permit removal of the EZLeaps product upon completion of the shoelace-tying process. Although the EZLeaps product aids an individual in the shoelace tying process, the design of the product has various drawbacks. For example, an individual requiring the EZLeaps product to tie a shoelace must carry around the EZLeaps product at all times in order to retie a shoelace that has come undone. This is highly inconvenient for individuals, especially for children who may forget to carry (or may not be permitted to carry) the EZLeaps product with them at all times (e.g., in school or day care settings).

SUMMARY OF THE DISCLOSURE

According to one embodiment, a system for tying a shoelace comprises a first shoe, a first shoelace, a first frame, a second frame, a second shoe, a second shoelace, a third frame, and a fourth frame. The first shoe comprises two or more eyelets and the first shoelace is laced through at least two of the two or more eyelets of the first shoe. The first frame comprises one or more protrusions and one or more apertures, wherein: at least one of the one or more apertures of the first frame comprises a diameter operable to receive a first end of the first shoelace; the one or more protrusions are positioned about the at least one of the one or more apertures; and the one or more protrusions of the first frame being operable to engage the first shoelace and resist movement of the first shoelace within the at least one aperture of the first frame. The second frame comprises one or more protrusions and one or more apertures, wherein: at least one of the one or more apertures of the second frame comprises a diameter operable to receive a second end of the first shoelace; the one or more protrusions of the second frame are positioned about the at least one of the one or more apertures of the second frame; and the one or more protrusions of the second frame are operable to engage the first shoelace and resist movement of the first shoelace within the at least one aperture of the second frame. The second shoe comprises two or more eyelets and the second shoelace is laced through at least two of the two or more eyelets of the second shoe. The third frame comprises one or more protrusions and one or more apertures, wherein: at least one of the one or more apertures of the third frame comprises a diameter operable to receive a first end of the second shoelace; the one or more protrusions of the third frame are positioned about the at least one of the one or more apertures of the third frame; and the one or more protrusions of the third frame are operable to engage the second shoelace and resist movement of the second shoelace within the at least one aperture of the third frame. The fourth frame comprises one or more protrusions and one or more apertures, wherein: at least one of the one or more apertures of the fourth frame comprises a diameter operable to receive a second end of the second shoelace; the one or more protrusions are positioned about the at least one aperture of the fourth frame; and the one or more protrusions of the fourth frame are operable to engage the second shoelace and resist movement of the second shoelace within the at least one aperture of the fourth frame.

According to another embodiment, a system for tying a shoelace comprises a first shoe, a first shoelace, and a first frame. The first shoe comprises two or more eyelets and first shoelace is laced through at least two of the two or more eyelets of the first shoe. The first frame comprises one or more protrusions and one or more apertures, wherein: at least one of the one or more apertures of the first frame comprises a diameter operable to receive a first end of the first shoelace; the one or more protrusions of the first frame are positioned about the at least one of the one or more apertures of the first frame; and the one or more protrusions of the first frame are operable to engage the first shoelace and resist movement of the first shoelace within the at least one aperture of the first frame.

According to yet another embodiment, a method for tying a shoelace comprises creating a first loop by inserting a first end of a shoelace in a first direction through a first aperture of a first frame and inserting the first end of the shoelace in a second direction through at least one from the set comprising: the first aperture of the first frame; and a second aperture of the first frame. The first aperture of the first frame comprises one or more protrusions that engage the shoelace and resist movement of the shoelace within the first aperture of the first frame. The second aperture of the first frame comprises one or more protrusions that engage the shoelace and resist movement of the shoelace within the second aperture of the first frame.

According to yet another embodiment, a frame for tying a shoelace comprises one or more protrusions and one or more apertures. At least one of the one or more apertures of the first frame comprises a diameter operable to receive a first end of the shoelace. The one or more protrusions of the first frame are positioned about the at least one of the one or more apertures of the first frame and the one or more protrusions of the first frame are operable to engage the first shoelace and resist movement of the first shoelace within the at least one aperture of the first frame.

Certain embodiments of the present disclosure may provide one or more technical improvements. One improvement of the one or more embodiments of the present disclosure is device that aids in the process of tying a shoelace. Another improvement of one or more embodiments of the present disclosure is one or more frames that secures a shoelace in one or more loops without the one or more loops needing to be maintained by a user when tying a knot. By doing so, the frame described herein may simplify the shoe-tying process. Still another improvement is the one or more protrusions on one or more apertures of the one or more frames that engage a shoelace and maintain its position within the frame. By doing so, the one or more protrusions help maintain the one or more frames engaged with a shoelace and maintain the position of the one or more frames relative to the shoelace allowing the one or more frames to maintain one or more loops. Still another improvement of certain embodiments of the present disclosure is a reduction in the time it takes to tie a shoelace, thereby potentially saving appreciable amounts of time when viewed in the aggregate of a lifetime of shoelace-tying. Still another improvement of certain embodiments of the present disclosure is the ability to leave the frame described herein coupled to the shoe and shoelace, thereby avoiding the inconvenience associated with conventional shoelace tying aids. Additionally, certain embodiments of the present disclosure may allow for aesthetic accessorizing with different visual designs. One or more other technical advantages may be readily apparent to one skilled in the art from the figures, descriptions, and claims, included herein.

BRIEF DESCRIPTION OF THE DRAWINGS

For a more complete understanding of the present disclosure and for further features and advantages thereof, reference is now made to the following description taken in conjunction with the accompanying drawings, in which.

DETAILED DESCRIPTION

Learning to tie a shoelace is a skill that most people learn to master during their lifetime. However, learning to tie a shoelace can pose significant challenges to some individuals. One of the most challenging parts of learning to tie a shoelace is securing a shoelace in one or more loops while tying a knot. As described above, the LSP Method requires the formation and securing of one loop, while the BE Method requires the formation and securing of two loops. Securing a shoelace loop requires a level of coordination that may be difficult to achieve, especially for individuals just beginning to learn how to tie shoelaces or those otherwise lacking the finger coordination required to hold one or more loops in position while performing the rest of a shoelace-tying method (e.g., due to disability). This makes the task prohibitively difficult for individuals who are young, disabled, suffer from arthritis, or otherwise lack precise finger control and dexterity. Even those with the ability to tie shoelaces may be slowed down by creating and holding the loops, adding up to significant amounts of time when aggregated over a lifetime of tying shoelaces.

The present disclosure describes and illustrates a system and method for tying a shoelace. The system and method utilize one or more frames that assist in the shoelace-tying process by securing the shoelace in one or more loops. By securing the shoelace in one or more loops, the operator's hands are free to perform other steps of the shoelace-tying process, such as those in the BE Method or the LSP Method. Accordingly, it is an object of the present disclosure that a frame (or frames) secure at least one loop in the process of tying a shoelace. As described above, utilizing one or more frames in a shoelace-tying process may make the shoe-tying process more efficient, as the one or more frames eliminate the need for an operator to form and secure one or more loops in the process of tying a shoelace.

Figure 1:
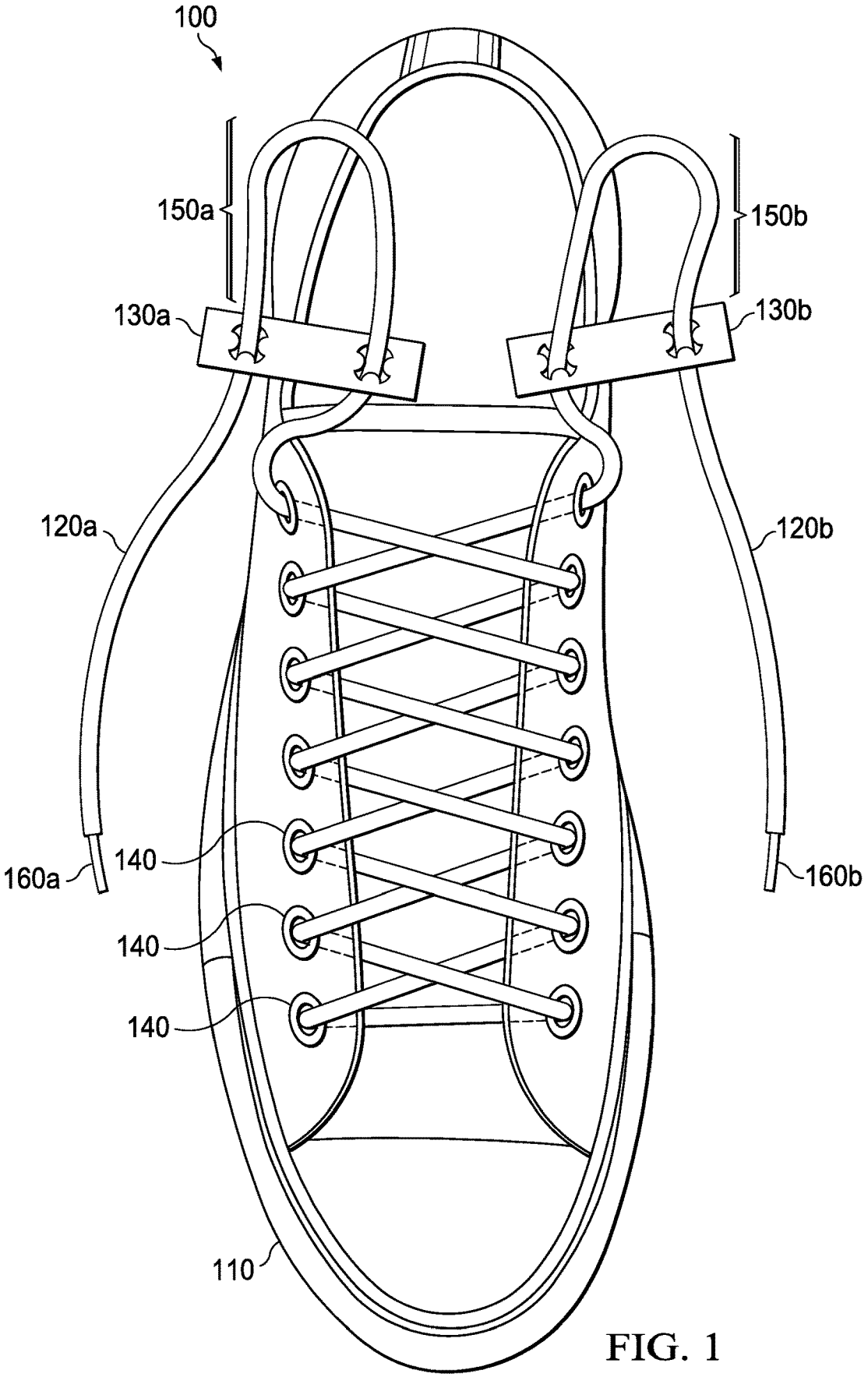
FIG. 1 illustrates a system for tying a shoelace, according to one embodiment of the present disclosure.
Figure 2:
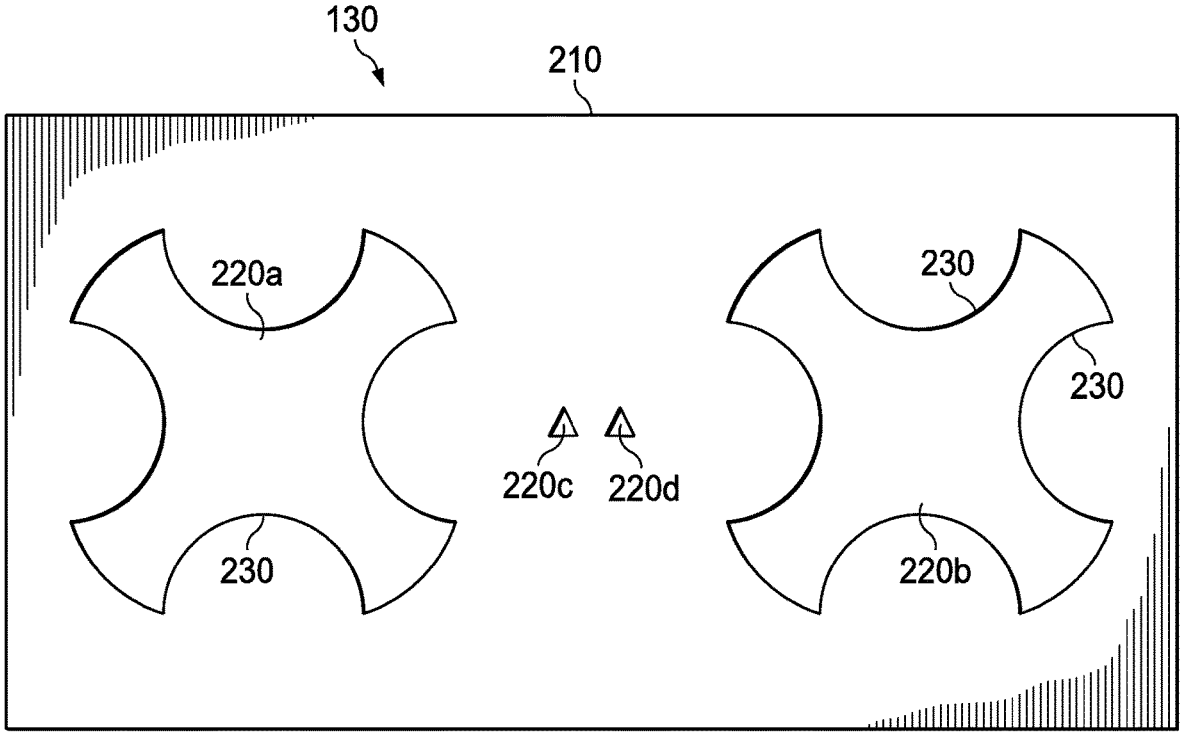
FIG. 2 illustrates a frame of the system of FIG. 1, according to certain embodiments of the present disclosure.
Figure 3:
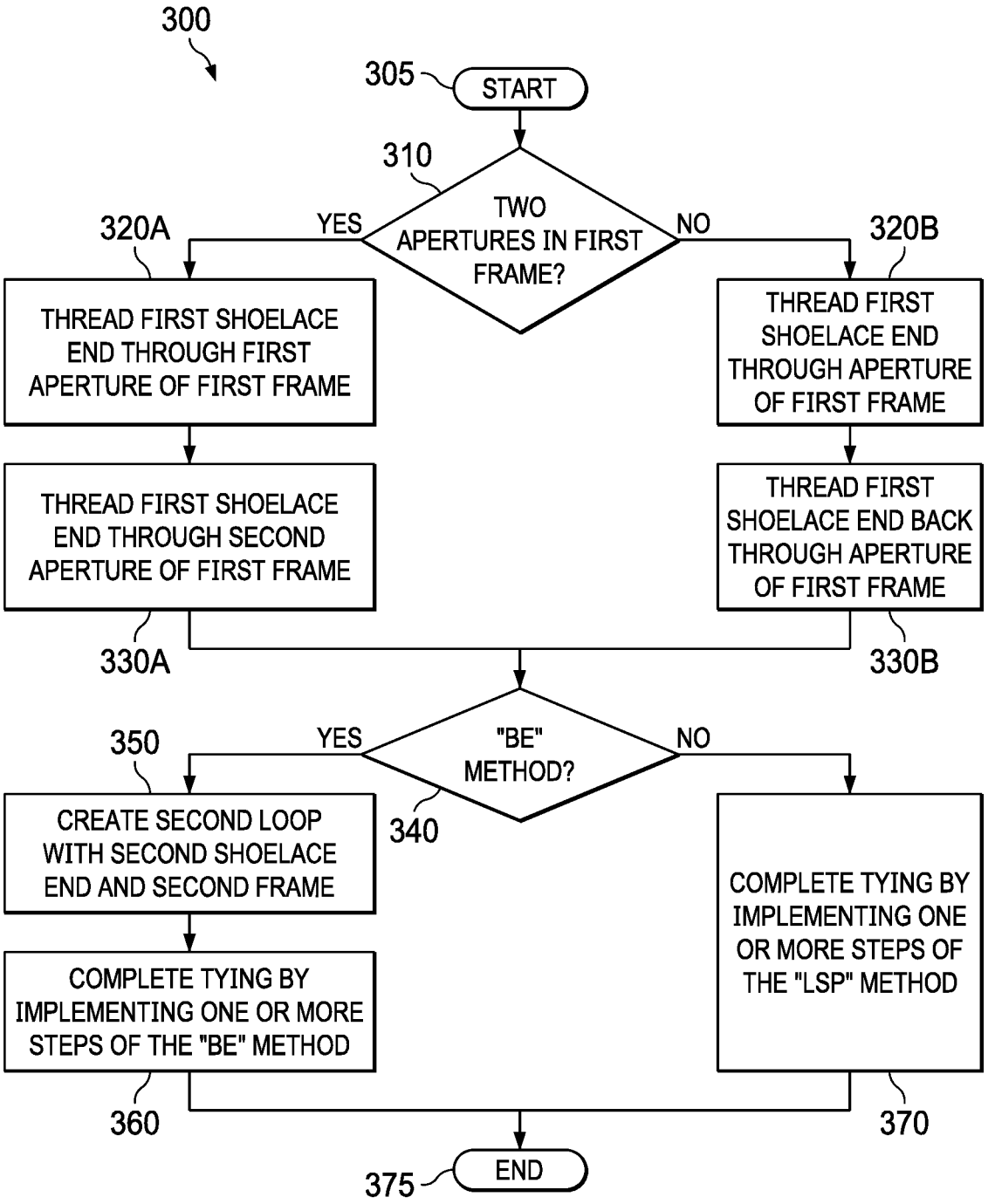
FIG. 3 is a flowchart illustrating a method of tying a shoelace using the frame of FIG. 2, according to certain embodiments.

Embodiments of the present disclosure and its advantages are best understood by referring to FIGS. 1-3, like numerals being used for like and corresponding parts of the various drawings.

FIG. 1 illustrates a system 100 for tying a shoelace 120. As depicted, system 100 includes a shoe 110, shoelace 120, and two frames 130*a*, 130*b*. Although system 100 is depicted as including two frames 130, this disclosure contemplates other embodiments wherein system 100 includes one frame 130 and still other embodiments wherein system 100 includes more than two frames 130 (e.g., up to four frames 130, two on each shoe 110).

In some embodiments, shoe 110 may include two or more eyelets 140. Eyelets 140 may be configured to accommodate shoelace 120. As illustrated in FIG. 1, shoelace 120 may be threaded through two or more eyelets 140 of shoe 110. As is also illustrated in FIG. 1, shoelace 120 may be threaded through one or more frames 130. This disclosure describes and depicts frames 130 in further detail with respect to FIG. 2.

As depicted in FIG. 1, shoelace 120 is untied. As discussed above, shoelace 120 may be tied in a knot. Although this disclosure describes particular examples of being "tied," this disclosure also contemplates other ways in which shoelace 120 may be tied. Generally, when an individual (e.g., a user) desires to put on a shoe, s/he inserts her/his foot into shoe 110 when it is untied and then ties shoelace 120 in order to secure shoe 110 on her/his foot. As described above, an individual may form one or more loops 150 from shoelace 120 in the process of tying shoelace 120. Employing frames 130 in the tying process may aid an individual in tying shoelace 120 as frames 130 are configured to secure shoelace 120 in one or more loops 150. As illustrated in FIG. 1, frame 130*a* secures a first end of shoelace 120*a* in a first loop 150*a* and frame 130*b* secures a second end of shoelace 120*b* in a second loop 150*b*.

Shoe 110, shoelace 120, and eyelets 140 may be of any suitable shape and size. For example, eyelets 140 may be round (e.g., circular, ovular, etc.) in shape and have a diameter large enough to accommodate shoelace 120 (e.g., 1.5 mm to 50 mm). As another example, shoelace 120 may be generally flat (or round) in shape and have a diameter small enough to be threaded through eyelets 140 (e.g., 3 mm to 20 mm). Shoe 110 and shoelace 120 may comprise any suitable material and/or any suitable combination of materials. For example, shoe 110 and/or shoelace 120 may be made from one or more of the following materials: leather, canvas, cotton, plastic, rubber, wood, nylon, satin, and denim.

As illustrated in FIG. 1, frame 130 is configured to secure shoelace 120 in one or more loops (e.g., loops 150*a*, 150*b*). In a two-frame embodiment such as the embodiment depicted in FIG. 1, frame-assisted shoelace tying may be achieved by threading one end (e.g., first end 120*a*) of shoelace 120 through a first frame 130 (e.g., frame 130*a*) and threading the other end (e.g., second end 120*b*) of shoelace 120 through a second frame 130 (e.g., frame 130*b*). A two-frame embodiment may be desirable for those individuals who tie shoelaces using the BE Method. In contrast, those who tie shoelaces according to the LSP Method may employ a one-frame embodiment, wherein only one end of shoelace 120 (e.g., first end 120*a* or second end 120*b*) is threaded through frame 130.

In some embodiments, frame(s) 130 are added to system 100 before tying a half-hitch knot. For example, as depicted in FIG. 1, frames 130*a* and 130*b* are added to system 100 without first tying a half-hitch knot. In other embodiments, frame(s) 130 are added to system 100 after tying a half-hitch knot. As such, this disclosure recognizes that frame(s) 130 may be added to system 100 before or after completion of a half-hitch knot.

Generally, FIG. 1 illustrates a system of tying a shoelace 120 that involves the use of one or more frames 130. FIG. 2 depicts a magnification of a frame 130, according to one embodiment. Finally, FIG. 3 illustrates a method of tying a shoelace using one or more frames 130.

As described above, FIG. 2 illustrates one embodiment of frame 130. As depicted, frame 130 includes a body 210 and four apertures 220 therethrough. In some embodiments, body 210 forms one or more protrusions 230. Protrusions 230 may extend from body 210 into one or more apertures 220. As depicted in FIG. 2, frame 130 includes a total of eight protrusions 230, four protrusions positioned about apertures 220*a*, 220*b*.

This disclosure recognizes that frame 130 may comprise any suitable number of apertures 220 and protrusions 230. For example, frame 130 may include one aperture 220 and one protrusion 230. As another example, frame 130 may include three or more apertures 220, each aperture 220 being surrounded by two or more protrusions 230. As yet another example, frame 130 may include six apertures 220 and only one protrusion 230. Although this disclosure recognizes that frame 130 may include a plurality of combinations of apertures 220 and protrusions 130, this disclosure recognizes that frame 130 must include a minimum of one aperture 220 and one protrusion 230.

Although frame 130 may include one or more other apertures 220, at least one aperture of frame 220 has a size and/or shape operable to accommodate shoelace 120. For example, as depicted in FIG. 2, apertures 220*a* and 220*b* of frame 130 have a size and/or shape operable to accommodate shoelace 120 but apertures 220*c* and 220*d* do not have a size and/or a shape operable to accommodate shoelace 120. Additionally, although this disclosure depicts apertures 220 and protrusions 230 of particular shapes, this disclosure recognizes that apertures 220 and protrusions 230 may be of any suitable shape that permits the functionality described herein.

Protrusions 230 may be positioned about one or more apertures 220 of frame 130. In some embodiments, one or more protrusions 230 are positioned about each aperture 220 of frame 130. In other embodiments, one or more protrusions 230 are positioned about only one aperture 220 of frame 130. This disclosure recognizes that frame 130 includes at least one protrusion 230 positioned about at least one aperture 220 that is operable to accommodate shoelace 120. Protrusions 230 are configured to engage with shoelace 120 and generally resist movement of shoelace 120 within aperture 220. Protrusions 230, however, may give under the application of an appropriate amount of force. For example, this disclosure recognizes that protrusions 230 may permit movement along shoelace 120 when a person pushes frame 130 along shoelace 120 (e.g., when threading shoelace 120 through aperture 220). Because protrusions 230 generally resist movement of shoelace 120 within aperture 220, frame 130 generally maintains (unless sufficient force is applied) the same position along shoelace 120. For example, if shoelace 120 is threaded through aperture(s) 220 such that shoelace 120 is configured into a loop (e.g., loop 150 of FIG. 1), protrusion(s) 230 will generally maintain the position of frame 130 along shoelace 120 and likewise hold shoelace 120 in a loop 150. By maintaining shoelace 120 in a loop 150, a user is able to complete a knot without having to hold a loop 150 maintained by frame 210.

In some embodiments, frame 130 is semi-rigid. As used herein, "semi-rigid" means that it is stiff and solid but not inflexible. The material comprising frame 130 may be sufficiently stiff enough to secure shoelace 120 in one or more loops (e.g., loops 150*a*, 150*b* of FIG. 1), but sufficiently flexible to be removed when desirable. In certain embodiments, frame 130 comprises a plastic grid material. Although this disclosure describes and depicts frame 130 in a particular manner, this disclosure recognizes that frame 130 may be comprised of any suitable material.

Moreover, just as individuals choose to make fashion statements with flashy and/or colorful shoelaces 120, individuals may also choose to make fashion statements with frame(s) 130. Accordingly, this disclosure recognizes that frame(s) 130 may be of any suitable shape, size, color and/or design. As one example, frame(s) 130 may be plain in color and round in shape. As another example, frame(s) 130 may be bright in color and take the shape of a flower. As yet another example, frame(s) 130 may be printed with a design and take the shape of a guitar pick. Although this disclosure describes particular exemplary designs of frame(s) 130, this disclosure recognizes that frame(s) 130 may take on any form which may reflect the personal style of an individual.

As described above, an individual may utilize one or more frames 130 to assist in tying shoelace 120. For example, as illustrated in FIG. 1, two frames 130 are used in system 100 to tie shoelace 120. Frames 130 may be added to system 100 by threading shoelace 120 through one or more apertures 220 of frame 130. After threading shoelace 120 through apertures 220, an individual may use frame 130 to secure shoelace 120 in one or more loops 150. In some embodiments, shoelace 120 is threaded through aperture 220 by inserting one end of shoelace 120 (e.g., 120*a*) through aperture 220 and pulling at least a portion of shoelace end 120 therethrough. As an example, an individual may thread first end of shoelace 120*a*, by inserting aglet 160*a* through aperture 220 first, through one or more apertures 220 of frame 130. In some embodiments, a loop 150 is created by first threading shoelace 120 through one or more apertures 220 in a first direction and then threading shoelace 120 through the one or more apertures 220 in a second direction, wherein the first direction is opposite the second direction.

Although this disclosure describes and depicts system 100 for tying shoelace 120 using two frames 130, of which each frame 130 comprises two apertures 220 having a sufficient size/shape to accommodate shoelace 120, this disclosure also acknowledges a system for tying shoelace 120 that uses only a single frame 130 (e.g., by implementing the LSP method). As one example, this disclosure recognizes tying shoelace 120 with a frame 130 having a single aperture 220 through which shoelace 120 may be inserted twice, once in each of two opposite directions. Further, other embodiments may only include a single frame 130, configured either with only a single aperture 220 or configured with multiple apertures 220.

Turning now to FIG. 3, a method 300 of tying a shoelace 120 is illustrated. Method 300 generally describes tying shoelace 120 using one or more frames 130. As described above, method 300 may be performed in order to create a bow and/or a knot from shoelace 120. Method 300 may be repeated as many times as necessary. For example, in order to tie two shoelaces 120 threaded through eyelets 140 of two separate shoes 110, method 300 may be repeated once for the second shoe 110. As described above, tying shoelaces 120 according to method 300 may make shoelace-tying easier and more convenient.

Method 300 may begin at a step 305. In some embodiments, step 305 occurs after a shoelace 120 has been threaded through one or more eyelets 140 of shoe 100. Method 300 may proceed to a step 310. At step 310, it is determined whether frame 130 includes two apertures 220 through which shoelace 120 may be thread. If at step 310 it is determined that frame 130 has two apertures 220 through which shoelace 120 may be threaded, method 300 may proceed to a step 320A. In contrast, if at step 310 it is determined that frame 130*a* does not have two apertures 220 through which shoelace 120 may be thread, method 300 may proceed to a step 320B.

At step 320A, a first end of shoelace 120 (e.g., first end 120*a*) is threaded through at least one aperture 220 of frame 130 (e.g., first aperture 220*a*). As described above, frame 130 may include one or more other apertures 220 through which shoelace 120 can be thread (e.g., apertures 220*a* and 220*b* of FIG. 2) and one or more apertures 220 through which shoelace 120 cannot be thread (e.g., apertures 220*c* and 220*d* of FIG. 2). At least one aperture 220 through which shoelace 120 can be thread has a diameter operable to receive shoelace end 120*a*. For example, first aperture 220*a* of FIG. 2 has a diameter operable to receive shoelace end 120*a*. First end 120*a* may be threaded through first aperture 220*a* by first inserting and pulling through, aglet 160*a* through aperture 220. In some embodiments, first end 120*a* is thread through aperture 220 in a first direction. First aperture 220*a* through which first end 120*a* is thread) may be surrounded by one or more protrusions 230. In other words, one or more protrusions 230 may be positioned about first aperture 220*a*. As stated above, protrusions 230 may be operable to engage shoelace end 120*a* and resist movement of shoelace 120 within aperture 220. Upon threading first end of shoelace 120*a* through aperture 220, method 300 may proceed to step 330A.

At step 330A, first end of shoelace 120*a* is thread through a second aperture 220 of frame 130 (e.g., second aperture 220*b*). In some embodiments, first end of shoelace 120*a* is thread through second aperture 220*b* in a second direction, the second direction being opposite the first direction (e.g., the direction through which first end of shoelace 120*a* is thread in step 320A). Second aperture 220*b* may have a diameter operable to receive the first end of shoelace 120*a*. Second aperture 220*b* may be surrounded by one or more protrusions 230. In other words, one or more protrusions 230 may be positioned about second aperture 220. As stated above, protrusions 230 may be operable to engage shoelace 120 and resist movement of shoelace 120. In some circumstances, threading first end of shoelace 120*a* through second aperture 220 creates a loop (e.g., loop 150*a*). First end of shoelace 120*a* may be held in loop 150*a*, at least in part, by one or more protrusions 230 positioned about first and/or second apertures 220. In some embodiments, after loop 150*a* is created, method 300 may proceed to step 340.

If at step 310, however, it was determined that frame 130 does not include two apertures 220 through which shoelace 120 may be threaded, then method 300 may proceed with step 320B. At step 320B, first end of shoelace 120*a* may be thread through an aperture 220 (e.g., first aperture 220*a*) of frame 130 having a diameter operable to receive first end of shoelace 120*a*. In some embodiments, first end of shoelace 120*a* is thread through first aperture 220*a* in a first direction. First aperture 220*a* (through which first end of shoelace 120*a* is threaded) may be surrounded by one or more protrusions 230 operable to engage shoelace 120 and resist movement of shoelace 120. Upon threading first end of shoelace 120*a* through first aperture 220*a*, method 300 may proceed to step 330B.

At step 330B, first end of shoelace 120*a* may be threaded back through the same aperture 220 as was thread through at step 320B (e.g., threaded back through first aperture 220*a*). This time, however, first end of shoelace 120*a* is thread through first aperture 220*a* in a second direction, the second direction being opposite the first direction mentioned in step 320B. By threading first end of shoelace 120*a* through the same aperture as the aperture 220 at step 320B, a loop 150 may be created. Loop 150 may be held in place by one or more protrusions 230 that engage shoelace 120. Upon creating loop 150, method 300 may proceed with step 340.

At step 340, it is determined what method will be used to tie shoelace 120. If at step 340 it is determined that shoelace 120 will be tied using the BE method, the method 300 may proceed with a step 350. If, however, at step 340, it is determined that shoelace 120 will be tied using the LSP method, the method may proceed to step 370. As described above, the BE method requires the formation of two loops 150 while the LSP method requires the formation of a single loop 150.

If at step 340 it is determined that the BE method will be used to tie shoelace 120, the method 300 proceeds to a step 350. At step 350, a second loop 150 (e.g., second loop 150*b*) is created. To create second loop 150, one or more steps of method 300 may be performed using second end of shoelace 120*b*. For example, second end of shoelace 120*b* may be thread through one or more apertures of a second frame 130. In some embodiments, second end of shoelace 120*b* is thread through a first aperture 220 of second frame 130 in a first direction and thread through a second aperture 220 of second frame 130 in a second direction, the second direction being opposite the first direction. In other embodiments, second end of shoelace 120*b* is thread through a first aperture 220 of second frame 130 in a first direction and thread through the same aperture 220 of second frame 130 in a second direction, the second direction being opposite the first direction. Upon creating second loop 150 using second frame 130, the method 300 may proceed to step 360.

At step 360, shoelace 120 is tied by performing one or more steps of the BE method. For example, shoelace 120 may be tied in a bow by creating a half-hitch knot using first and second loops 150 created at steps 330 and 350. In some embodiments, after tying shoelace 120, the method 300 proceeds to an end step 375.

If, however, it is determined at step 340 that the BE method will not be used to tie shoelace 120, the method may proceed to a step 370. At step 370, shoelace 120 is tied by performing one or more steps of the LSP method. For example, loop 150 created at step 330 may be circumscribed using second end of shoelace 120*b* to create a ring about loop 150. As another example, after circumscribing loop 150, second end of shoelace 120*b* may be thread through the created ring, constricting the ring and thereby forming a bow. In some embodiments, after one or more steps of the LSP are performed, the method 300 proceeds to an end step 375.

Various embodiments may perform some, all, or none of the steps described above. For example, in certain embodiments, only one loop 150 would be required; whereas, other embodiments may require two or more loops 150. Furthermore, certain embodiments may perform these steps in a different order than that illustrated and/or in parallel with other steps. In certain embodiments, one or more steps of method 300 may be repeated.

Modifications, additions, or omissions may be made to system 100 without departing from the scope of the disclosure. Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

The invention claimed is:

1. A method for tying a shoelace, the method comprising:

creating a first loop by:

inserting a first end of a shoelace in a first direction through a first aperture of a first frame, wherein:

the first aperture of the first frame comprises one or more protrusions that engage the shoelace and resist movement of the shoelace within the first aperture of the first frame; and the first aperture of the first frame does not extend to an edge of the first frame;

inserting the first end of the shoelace in a second direction through at least one from the set comprising:

the first aperture of the first frame; and a second aperture of the first frame, wherein the second aperture of the first frame comprises one or more protrusions that engage the shoelace and resist movement of the shoelace within the second aperture of the first frame;

circumscribing the first loop using a second end of the shoelace, wherein circumscribing the first loop creates a ring about the first loop;

threading the shoelace through the ring;

constricting the ring to form a bow, the bow being formed atop the first frame; and wherein the first frame cannot be removed from the first shoelace unless the bow is first untied.

2. The method of claim 1, wherein the first frame is operable to maintain the first end of a shoelace in the first loop without assistance from a user.

3. The method of claim 1, wherein the first frame is operable to maintain the second end of a shoelace in a second loop without assistance from a user.

* * * * *